US008139784B2

(12) United States Patent
Oclee-Brown

(10) Patent No.: US 8,139,784 B2
(45) Date of Patent: Mar. 20, 2012

(54) COMPOUND LOUDSPEAKER

(75) Inventor: Jack Anthony Oclee-Brown, Tonbridge (GB)

(73) Assignee: GP Acoustics (UK) Limited, Crawley, West Sussex (GB)

( * ) Notice: Subject to any disclaimer, the term of this patent is extended or adjusted under 35 U.S.C. 154(b) by 685 days.

(21) Appl. No.: 11/922,686

(22) PCT Filed: Jun. 21, 2006

(86) PCT No.: PCT/GB2006/002267

§ 371 (c)(1),
(2), (4) Date: Mar. 5, 2009

(87) PCT Pub. No.: WO2006/136816

PCT Pub. Date: Dec. 28, 2006

(65) Prior Publication Data

US 2009/0214063 A1 Aug. 27, 2009

(30) Foreign Application Priority Data

Jun. 22, 2005 (GB) ..... 0512703.0

(51) Int. Cl.
*H04R 1/02* (2006.01)
*H04R 9/06* (2006.01)
*H04R 3/00* (2006.01)

(52) U.S. Cl. ..... 381/89; 381/332; 381/335; 381/336; 381/96; 381/337; 381/347; 381/354; 381/186; 381/429; 181/146; 181/150; 181/151; 181/165; 181/173

(58) Field of Classification Search ..... 381/89, 381/332, 335, 336, 96, 337, 345, 346, 347, 381/354, 186, 398, 423, 424, 429; 181/145, 146, 147, 150, 151, 154, 163, 164, 165, 166, 173

See application file for complete search history.

(56) References Cited

U.S. PATENT DOCUMENTS 5,548,657 A 8/1996 Fincham
6,647,122 B1 11/2003 Jones ..... 381/182
7,274,798 B2 * 9/2007 Ohashi et al. ..... 381/430

(Continued)

FOREIGN PATENT DOCUMENTS

EP 0 095 876 A2 12/1983

(Continued)

OTHER PUBLICATIONS

Notification of Transmittal of the International Search Report, PCT/GB2006/002267 dated Sep. 29, 2006.

(Continued)

*Primary Examiner* — Ngan Ngo
(74) *Attorney, Agent, or Firm* — Kenneth L. Sherman, Esq.; Michael Zarrabian, Esq.; Myers Andras Sherman & Zarrabian LLP

(57) ABSTRACT

A compound loudspeaker comprises an acoustically radiating first diaphragm and an acoustically radiating second diaphragm. The first and second diaphragms are substantially coaxial and at least part of the second diaphragm is situated radially outwards of the first diaphragm. There is a gap situated between the first and second diaphragms, and a seal is provided in the gap, thereby preventing or hindering the passage of air through the gap. By providing the seal, the invention solves the problem of audible turbulent airflow through the gap.

18 Claims, 3 Drawing Sheets

U.S. PATENT DOCUMENTS

| | | | | |
|---|---|---|---|---|
| 7,933,429 | B2 * | 4/2011 | Lutz | 381/409 |
| 2005/0175205 | A1 * | 8/2005 | Takahashi | 381/336 |
| 2006/0072777 | A1 * | 4/2006 | Ohashi et al. | 381/430 |
| 2006/0088184 | A1 * | 4/2006 | Ohashi et al. | 381/430 |
| 2008/0232635 | A1 * | 9/2008 | Corynen | 381/398 |

FOREIGN PATENT DOCUMENTS

| | | | |
|---|---|---|---|
| EP | 0 147 992 | A2 | 7/1985 |
| EP | 0 624 048 | A1 | 11/1994 |
| GB | 311486 | | 5/1929 |
| GB | 665815 | | 1/1952 |
| JP | 56-132094 | A | 10/1981 |
| JP | 59-010099 | A | 1/1984 |
| JP | 59-216398 | A | 6/1984 |
| JP | 60-019399 | A | 1/1985 |
| WO | WO 91/17636 | | 11/1991 |

OTHER PUBLICATIONS

Great Britain Search Report, Application No. GB0512703.0, dated Aug. 26, 2005.

Written Opinion of the International Searching Authority, PCT/GB2006/002267.

* cited by examiner

COMPOUND LOUDSPEAKER

CROSS REFERENCE TO RELATED APPLICATIONS

The present application is a national stage application under 35 U.S.C. 371 of PCT/GB2006/002267 filed Jun. 21, 2006, which claims priority of GB 0512703.0 filed Jun. 22, 2005, both applications being hereby incorporated by reference in their entirety.

BACKGROUND OF THE INVENTION

1. Field of the Invention

The present invention relates to loudspeakers, and particularly relates to compound loudspeakers, that is, loudspeakers comprising at least two acoustically radiating diaphragms.

2. Description of Related Art

Compound loudspeakers have been known for many years. For example, U.S. Pat. No. 5,548,657 (KEF Audio (UK) Limited) discloses a compound loudspeaker comprising an acoustically radiating dome-shaped high frequency diaphragm and an acoustically radiating low frequency conical diaphragm. The compound loudspeaker illustrated in U.S. Pat. No. 5,548,657 is shown in FIG. 1 of the present accompanying drawings. The two diaphragms of the loudspeaker 1 are substantially coaxial and the low frequency conical diaphragm 3 is situated radially outwards of the dome-shaped high frequency diaphragm 5. A narrow annular air gap 7 is present between the neck 9 of the conical diaphragm 3 and the external diameter of an annular baffle 11 surrounding the dome-shaped diaphragm. This gap provides a passage for air between the inside and the outside of the loudspeaker cabinet (the cabinet is not illustrated, but in practice encloses the periphery and rear of the compound loudspeaker). The gap needs to be narrow to ensure that the high frequency response of the dome-shaped diaphragm is unaffected by diffraction from the gap (the gap being a discontinuity). However, in some circumstances, for example if the cabinet of the compound loudspeaker is small, and the loudspeaker is operated at low frequencies, the difference in air pressures between the interior and the exterior of the cabinet can be great. When the low frequency diaphragm is operated at large excursions (i.e. large forward and back sound-generating motions), the air pressure differential can be sufficient to force air to flow through the gap, causing audible turbulent airflow, which clearly is undesirable.

BRIEF SUMMARY OF THE INVENTION

The present invention seeks (among other things) to provide a solution to this problem.

Accordingly, a first aspect of the present invention provides a compound loudspeaker, comprising an acoustically radiating first diaphragm and an acoustically radiating second diaphragm, the first and second diaphragms being substantially coaxial and at least part of the second diaphragm being situated radially outwards of the first diaphragm, there being a gap situated between the first and second diaphragms, and wherein a seal is provided in the gap, thereby to prevent or hinder the passage of air through the gap.

By providing a seal that prevents or hinders the passage of air through the gap situated between the first and second diaphragms, the invention can solve the problem of audible turbulent airflow through the gap.

Preferably, the seal substantially prevents the passage of air through the gap caused by sound-generating motions of one or both of the first and second diaphragms.

The first diaphragm will normally have a substantially circular periphery. The second diaphragm will normally be substantially annular, that is, the second diaphragm will usually have a substantially circular periphery, and usually a central circular region of the second diaphragm will be absent, thus providing space for the central first diaphragm. Consequently, the gap situated between the first and second diaphragms will normally be substantially annular. The seal will normally therefore need to be substantially annular, even though in many embodiments of the invention, the gap does not extend the entire distance between the first and second diaphragms but may, for example, extend between one of the diaphragms and another structure situated between the diaphragms.

The acoustically radiating first diaphragm of the compound loudspeaker according to the invention preferably comprises a high frequency diaphragm. The high frequency diaphragm advantageously is a dome-shaped diaphragm. The acoustically radiating second diaphragm preferably comprises a low frequency diaphragm (which term preferably includes mid-range frequencies). Advantageously, the low frequency diaphragm may be a generally conical diaphragm.

The seal preferably is flexible. For example, the seal may be attached directly or indirectly to one or both of the first and second diaphragms and arranged to flex in response to sound-generating motions of the diaphragm(s) in use. As just indicated, in some embodiments of the invention, the loudspeaker includes a structure surrounding the first diaphragm. In such embodiments, the gap will normally extend between the structure and the second diaphragm, and consequently in such embodiments the seal will normally be attached to the structure and the second diaphragm. At least part of the structure surrounding the first diaphragm may, for example, comprise a horn or baffle structure.

In preferred embodiments, at least part of the seal may be in the form of a membrane. For example, the seal may comprise a generally annular membrane having radially inner and outer edge regions and having a flexible region extending between the edge regions.

In preferred embodiments of the invention, seal fulfils some or all of the following criteria:

- any discontinuity between the low frequency and high frequency diaphragms (including any baffle or small horn part surrounding the low frequency diaphragm) generally needs to be small, in order for the performance of the high frequency diaphragm to be maximised;
- the seal normally needs have small radial width so that it can fit in the narrow annular gap between the high frequency diaphragm assembly and the low frequency diaphragm;
- the seal generally must allow the necessary sound-generating axial motion of the low-frequency diaphragm;
- the seal preferably has a stiffness under axial deformation that does not add significant compliance nonlinearity to the low-frequency diaphragm; that is, the relationship between the stiffness of the seal and its deformation preferably is very linear or very small; and
- the seal preferably completely seals the gap between the low frequency diaphragm and the high frequency diaphragm assembly.

The inventor of the present invention has found that the above preferred criteria cannot be met using a conventional "half roll" surround seal. A "half roll" seal is an annular seal, the main flexibility of which is provided by a part that is substantially semi-circular in cross-section—for example such as the seal 13 surrounding the high frequency diaphragm 5 shown in FIG. 1. The inventor has found that such a seal cannot be made sufficiently small to fit into the gap, while allowing sufficient axial movement of the low frequency diaphragm. The relationship between the stiffness of a "half roll" seal and its deformation means that the seal must be large, but this causes the problem that the discontinuity between the high frequency diaphragm assembly and the low frequency diaphragm is too great.

The inventor has found that a seal having some or all of the following preferred features can normally meet some or all of the above preferred criteria.

As mentioned above, the seal preferably comprises a generally annular membrane having radially inner and outer edge regions and having a flexible region extending between the edge regions. Preferably, the flexible region comprises generally ring-shaped regions extending from respective edge regions of the seal and joined together at ends remote from the edge regions by a flexible joining region. Advantageously, in some embodiments of the invention each generally ring-shaped region is a generally cylindrical region. The joining region preferably is substantially semi-circular in radial cross-section. More preferably, the minimum distance between the joining region and an edge region along a ring-shaped region is at least 1.5 times the minimum distance between the edge regions, when the seal is in a relaxed condition. Even more preferably, this minimum distance is at least twice the minimum distance between the edge regions, when the seal is in a relaxed condition.

A second aspect of the invention provides a loudspeaker seal comprising a generally annular membrane having radially inner and outer edge regions and having a flexible region extending between the edge regions, the flexible region comprising generally cylindrical regions extending from respective edge regions and joined together at ends remote from the edge regions by a flexible joining region.

A third aspect of the invention provides a loudspeaker seal comprising a generally annular membrane having radially inner and outer edge regions and having a flexible region extending between the edge regions, the flexible region comprising first and second generally ring-shaped regions extending from respective edge regions and joined together at ends remote from the edge regions by a flexible joining region, wherein the minimum distance between the joining region and an edge region along a ring-shaped region is at least 1.5 times the minimum distance between the edge regions, when the seal is in a relaxed condition.

In some preferred embodiments of the third aspect of the invention, the minimum distance between the joining region and an edge region along a ring-shaped region is at least twice the minimum distance between the edge regions, when the seal is in a relaxed condition.

Each generally ring-shaped region of the seal according to the third aspect of the invention preferably is a generally cylindrical region.

The seal according to the second and/or third aspect of the invention preferably is the seal of the compound loudspeaker according to the first aspect of the invention.

It is to be understood that any feature of any aspect of the present invention may be a feature of any other aspect of the invention.

Other preferred and optional features of the invention are described below, and in the dependent claims.

BRIEF DESCRIPTION OF THE DRAWINGS

Some preferred embodiments of the present invention will now be described, by way of example, with reference to the accompanying drawings, of which.

DETAILED DESCRIPTION OF THE INVENTION

Figure 1:
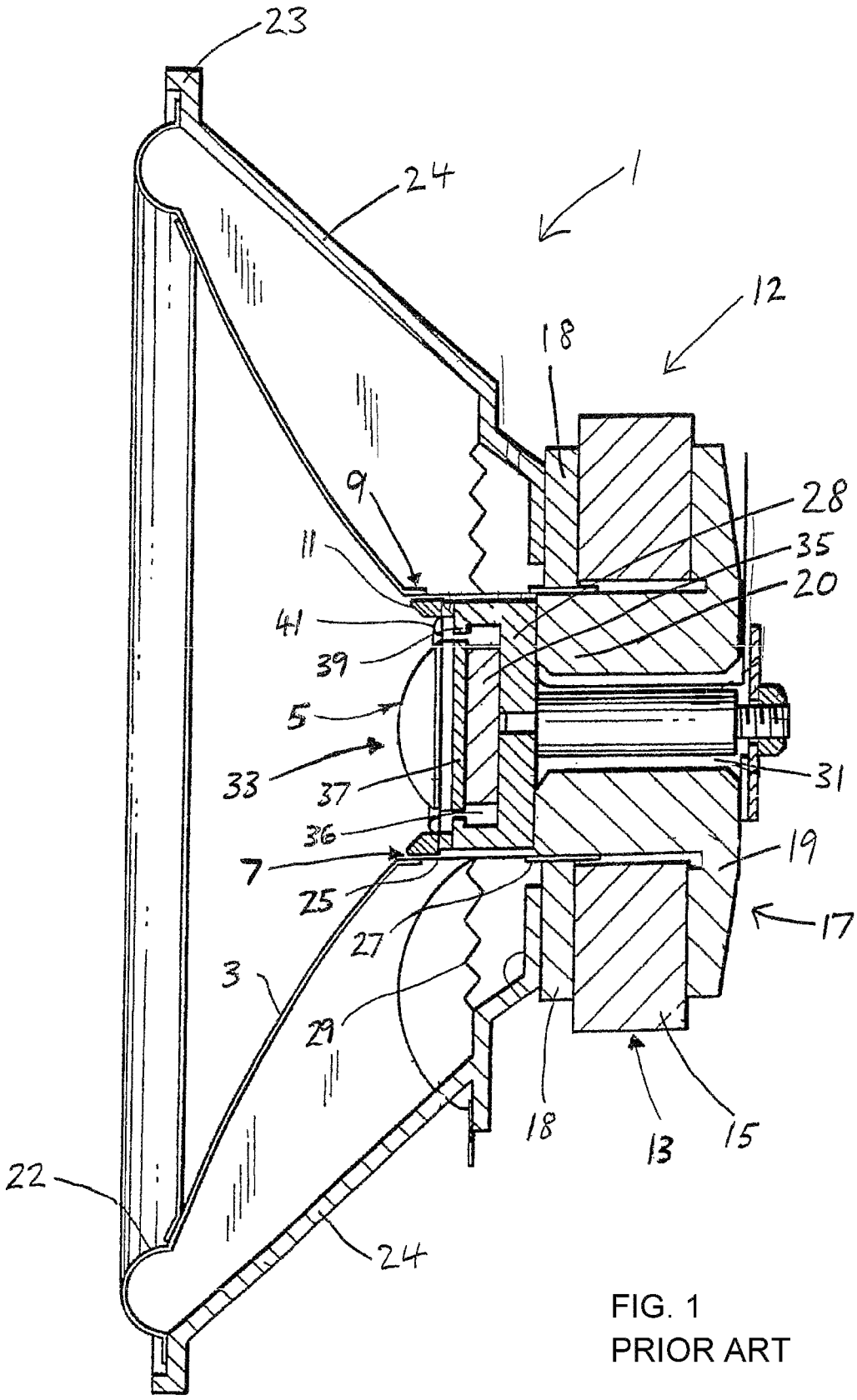
FIG. 1 PRIOR ART
FIG. 1 shows a known compound loudspeaker, as illustrated in U.S. Pat. No. 5,548,657.

FIG. 1 has been described above. The two diaphragms of the loudspeaker 1 are substantially coaxial and the low frequency conical diaphragm 3 is situated radially outwards of the dome-shaped high frequency diaphragm 5. A narrow annular air gap 7 is present between the neck 9 of the conical diaphragm 3 and the external diameter of an annular baffle structure 11 surrounding the dome-shaped diaphragm. This gap provides a passage for air between the inside and the outside of the loudspeaker cabinet (the cabinet is not illustrated, but in practice encloses the periphery and rear of the compound loudspeaker). The gap needs to be narrow to ensure that the high frequency response of the dome-shaped diaphragm is unaffected by diffraction from the gap (the gap being a discontinuity).

A magnetic structure 13 of a drive unit 12 of the compound loudspeaker 1 comprises a magnet ring 15, which may for example be formed of barium ferrite, a front annular plate 18 which forms an outer pole, and a member 17 which forms a backplate 19 and an inner pole 20. The low frequency diaphragm 3, which is of generally frusto-conical form, is supported along the front outer edge thereof by a flexible surround 22 secured to a front rim 23 of a chassis 24. A tubular former 25 is secured to the rear edge of the diaphragm 3 and is arranged to extend into an air gap between the poles 18 and 20. The former 25 carries a voice coil 27 positioned on the former such that the coil extends through the air gap. A suspension member 29, for example in the form of a spider consisting of inner and outer rings interconnected by flexible legs, or consisting of a corrugated sheet having annular corrugations, is secured between the former 25 and the chassis 24 in order to ensure that the former, and the voice coil carried thereby, are maintained concentric with the poles of the magnetic structure and out of physical contact with the poles during sound producing excursions of the diaphragm 3. The member 17 forming the backplate 19 and inner pole 20 has a bore 31 extending co-axially thereof for the purpose of mounting a drive unit 33 for the high frequency diaphragm 5.

The drive unit 33 for the high frequency diaphragm 5 comprises a second magnetic structure consisting of a pot 28, a disc shaped magnet 35 and a disc shaped inner pole 37. The pot 28 has a cylindrical outer surface dimensioned to fit within the interior of the coil former 25 without making physical contact therewith. The pot is formed with an annular lip 39 to form an outer pole. The high frequency domed diaphragm 5 has an annular surround seal 41. Secured to the domed diaphragm 5 is a cylindrical former carrying a high frequency voice coil 36 such that the voice coil extends through an air gap between the poles of the magnetic structure of the high frequency drive unit 33. A small annular horn baffle 11 having a frusto-conical front surface is secured to the front of the high frequency drive unit to provide a continuation of the surface of the low frequency diaphragm 3 towards the domed high frequency diaphragm.

The compound loudspeaker according to the present invention may, for example, comprise a compound loudspeaker 1 as shown in FIG. 1, and as described above, but with a seal provided in the gap 7 to prevent or hinder the passage of air through the gap 7.

The low frequency conical diaphragm 3 is shown in FIG. 1 as being of generally conical form, having an angle of flare that increases from the neck of the diaphragm toward the outer periphery of the diaphragm. However it will be appreciated that the diaphragm may, for example, be of conical form having a uniform angle of flare. Also, the low frequency diaphragm may be of circular, elliptical or other section as desired.

The high frequency diaphragm is shown in FIG. 1 as being of domed form. Such a diaphragm is suitable because its acoustic centre may readily be located in close coincidence with that of the low frequency diaphragm, and because, in the frequency range where both drive units contribute significant sound output, its small size relative to wavelength gives it, by itself, essentially non-directional sound radiation, allowing the effective directivity to be determined by the low frequency diaphragm. It will be appreciated that the high frequency diaphragm may alternatively be of any other form, preferably that provides these characteristics.

Figure 2:
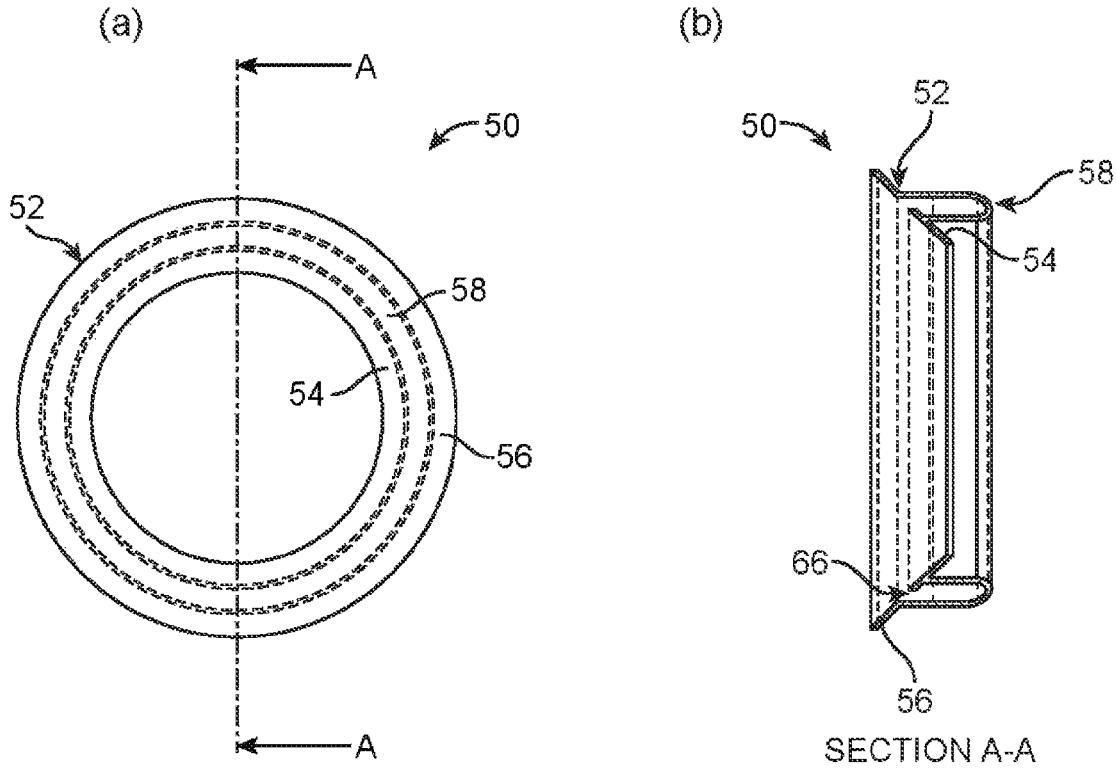
FIG. 2 (views (*a*) and (*b*)) shows an embodiment of a loudspeaker seal according to the present invention.
Figure 3:
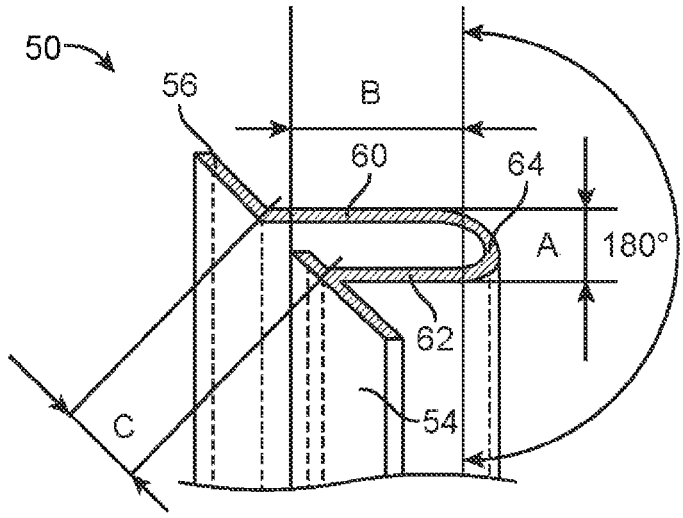
FIG. 3 shows a detail of the loudspeaker seal shown in FIG. 2.

FIG. 2 (views (*a*) and (*b*)) and FIG. 3 show a preferred embodiment of a loudspeaker seal according to the present invention. FIG. 2 (*a*) shows the seal in plan view, and FIG. 2 (*b*) shows a cross-section A-A of the seal. FIG. 3 shows a detail of the cross-section A-A of the same seal. The seal 50 comprises a generally annular membrane 52 having a radially inner edge region 54 and a radially outer edge region 56. A flexible region 58 extends between the edge regions 52 and 54, the flexible region comprising generally ring-shaped regions 60 and 62 extending from respective edge regions 56 and 54. The generally ringed-shaped regions 60 and 62, which in fact are generally cylindrical in this embodiment, are joined together at ends remote from the edge regions by a flexible joining region 64. The flexible joining region 64 is substantially semi-circular in cross-section, as shown in FIG. 3 and indicated by the 180 degree. arc marked on the figure.

The radially inner and radially outer edge regions 54 and 56 constitute spaced-apart regions of a generally frusto-conical membrane (i.e. a membrane in the general shape of a truncated cone). In use, when the seal 50 is situated in a gap 7 in a compound loudspeaker (e.g. of the type illustrated in FIG. 1), the concave surface of the truncated cone preferably faces forward, in the same general direction as the acoustically radiating diaphragms, and it for example constitutes an approximate continuation of the cone of the low frequency diaphragm 3.

The inner and outer edge regions 54 and 56 of the seal 50 may be, and preferably are, flexible. Between the radially inner and outer edge regions 54 and 56, the flexible region 58 takes the form of a "fold" of the frusto-conical membrane, which fold protrudes away from the truncated cone formed by the edge regions. The "fold" formed by the flexible region may project either outside the truncated cone of the membrane (e.g. as shown in FIGS. 2 and 3), or inside the truncated cone of the membrane (not shown but, for example, in the opposite direction to the direction illustrated). It is generally preferred for the fold to project outside the truncated cone, because this normally means that the fold projects behind the front of the acoustically radiating diaphragms in use (rather than projecting from the front). By projecting in this way, the fold presents less of a discontinuity in the forward-facing surface of the truncated cone. The fold preferably projects substantially coaxially with the axis of the truncated cone, as illustrated in FIGS. 2 and 3. However, the fold could project non-coaxially from the truncated cone. Also, as illustrated, the presence of the fold-shape provided by the ring-shaped regions 60 and 62 results in an opening 66 between the edge regions 52 and 54. However, in some embodiments of the invention, the opening 66 may be partially closed by an extending member (e.g. a flap) projecting from one or both edge regions 52, 54, partially across the opening 66. In this way, the discontinuity in the forward facing surface of the seal 50 is lessened while keeping the fold open to the atmosphere, thereby allowing it to change shape (deform) as shown in FIG. 4 (described below) substantially without being hindered by internal air pressures.

In the embodiment of the loudspeaker seal 50 illustrated in FIGS. 2 and 3, the minimum distance between the joining region 64 and an edge region along a ring-shaped region is at least 1.5 times the minimum distance C between the edge regions, when the seal is in a relaxed condition (which it is, in FIGS. 2 and 3). For the seal 50 illustrated in FIGS. 2 and 3, the minimum distance between the joining region 64 and an edge region along a ring-shaped region is the distance B along the ring-shaped region 62 (rather than the distance along the ring-shaped region 64) because ring-shaped region 62 is shorter than ring-shaped region 64. Consequently, distance B is at least 1.5 times distance C. (In fact, for the seal 50 illustrated in FIGS. 2 and 3, distance B is approximately 1.6 times distance C.) This minimum ratio between distances B and C has been found by the present inventor to allow the necessary sound-generating axial motion of the low frequency diaphragm 3 while keeping the discontinuity between the low frequency diaphragm 3 and the high frequency diaphragm 5 sufficiently small so that the performance of the high frequency diaphragm is not significantly compromised.

Figures 4A, 4B:
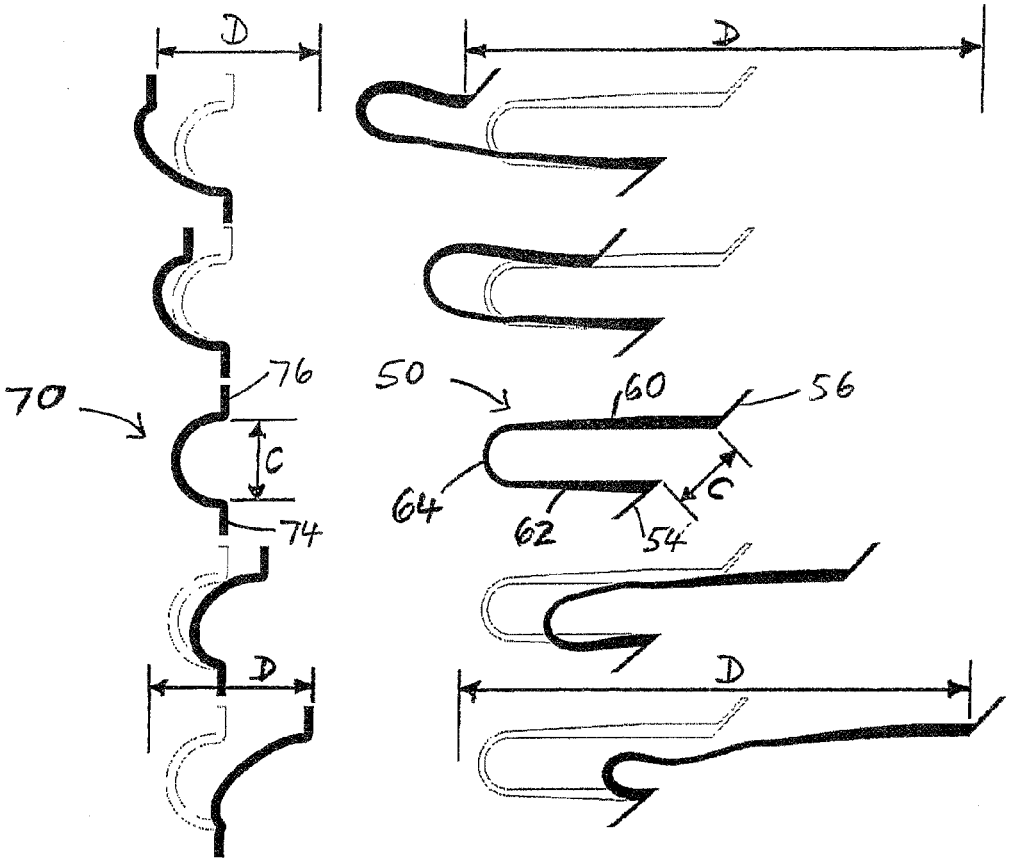
FIG. 4(a) PRIOR ART
FIG. 4 shows computer modelling simulations of deformations of an embodiment of a loudspeaker seal according to the invention in use (view (*b*)), compared to those for a known type of seal (view (*a*)).

FIG. 4 shows computer modelling simulations of deformations of an embodiment of a loudspeaker seal according to the invention in use (view (*b*)), compared to those for a known type of seal (view (*a*)). As illustrated, the known "half-roll" type seal 70 (e.g. of the type indicated by reference numeral 41 in FIG. 1) is able to provide only a relatively small maximum excursion distance D for a given separation C between edge regions 74 and 76 of the seal. (The maximum excursion distance D is the maximum excursion distance of the neck of the low frequency diaphragm 3 as it undergoes sound-generating axial motions.) In contrast, a seal 50 according to the invention is able to provide a relatively large maximum excursion distance D for a given separation C between edge regions 54 and 56 of the seal.

For the known type of seal 70, if the separation C is small enough not to compromise the performance of the high frequency diaphragm 5 significantly, the excursion distance D is insufficient for the low frequency diaphragm 3, i.e. the seal 70 hinders the sound-generating motions of the low frequency diaphragm. Alternatively, if the known seal 70 is made large enough so that the excursion distance D is sufficient for the low frequency diaphragm 3, then the separation C is large enough to compromise the performance of the high frequency diaphragm 5 significantly. In contrast, for the seal 50 according to the invention, if the separation C is small enough not to compromise the performance of the high frequency diaphragm 5 significantly, the excursion distance D is sufficient for the low frequency diaphragm 3, i.e. the seal 50 does not hinder the sound-generating motions of the low frequency diaphragm to any significant degree. Also, the presence of the seal 50 in the gap 7 in the compound loudspeaker 1 prevents air being forced through the gap by the sound-generating motions of the low frequency diaphragm. Consequently, the problem of audible turbulent airflow caused by the motions of the low frequency diaphragm, is solved.

The invention claimed is:

1. A compound loudspeaker, comprising:

an acoustically radiating first diaphragm; and an acoustically radiating second diaphragm, the first and second diaphragms being substantially coaxial and at least part of the second diaphragm being situated radially outwards of the first diaphragm, there being a gap situated between the first and second diaphragms, and wherein a seal is provided in the gap, thereby to prevent or hinder passage of air through the gap, the seal comprising first and second edge regions, and a flexible region connecting the first and second edge regions, and projecting inwardly to define a volume which opens to the atmosphere at an opening between the first and second edge regions, the compound loudspeaker further comprising a member extending partially across the opening.

2. The loudspeaker according to claim 1, wherein the seal substantially prevents the passage of air through the gap caused by sound-generating motions of one or both of the first and second diaphragms.

3. The loudspeaker according to claim 1, wherein the seal is flexible.

4. The loudspeaker according to claim 1, wherein the seal comprises a membrane.

5. The loudspeaker according to claim 1, wherein the seal is generally annular.

6. The loudspeaker according to claim 1, wherein the seal is attached directly or indirectly to one or both of the first and second diaphragms and is arranged to flex in response to sound-generating motions of the diaphragm(s) in use.

7. The loudspeaker according to claim 1, further comprising a structure surrounding the first diaphragm, the structure having a surface adapted to serve as a continuation of the surface of the second diaphragm, wherein the gap is between the structure and the second diaphragm, and wherein the seal is attached to the structure and the second diaphragm.

8. The loudspeaker according to claim 7, wherein at least part of the structure surrounding the first diaphragm comprises a baffle structure or horn structure.

9. The loudspeaker according to claim 1, wherein the seal comprises a generally annular membrane with the first edge region comprising a radially inner edge region and the second edge region comprising an outer edge region.

10. The loudspeaker according to claim 9, wherein the flexible region comprises generally ring-shaped or generally cylindrical regions extending from respective edge regions of the seal and joined together at ends remote from the edge regions by a flexible joining region.

11. The loudspeaker according to claim 10, wherein the radially inner and outer edge regions constitute spaced-apart regions of a generally frusto-conical membrane and said member projects from one or both of said edge regions.

12. The loudspeaker according to claim 10, wherein the joining region is substantially semi-circular in radial cross-section.

13. The loudspeaker according to claims 10, wherein the minimum distance between the joining region and an edge region along a ring-shaped region is at least 1.5 times the minimum distance between the edge regions, when the seal is in a relaxed condition.

14. The loudspeaker according to claim 1, wherein the acoustically radiating first diaphragm comprises a high frequency diaphragm.

15. The loudspeaker according to claim 14, wherein the high frequency diaphragm is a dome-shaped diaphragm.

16. The loudspeaker according to claim 1, wherein the acoustically radiating second diaphragm comprises a low frequency diaphragm.

17. The loudspeaker according to claim 16, wherein the low frequency diaphragm is a substantially conical diaphragm.

18. A loudspeaker seal configured for use in a compound loudspeaker, the loudspeaker seal comprising:

first and second edge regions; and a flexible region connecting the first and second edge regions, wherein the compound loudspeaker comprises:

an acoustically radiating first diaphragm; and an acoustically radiating second diaphragm, the first and second diaphragms being substantially coaxial and at least part of the second diaphragm being situated radially outwards of the first diaphragm, there being a gap situated between the first and second diaphragms, and wherein the loudspeaker seal is provided in the gap, thereby to prevent or hinder passage of air through the gap, and projects inwardly to define a volume which opens to the atmosphere at an opening between the first and second edge regions, wherein the compound loudspeaker further comprising a member extending partially across the opening.

* * * * *